US008834139B2

(12) United States Patent
Yamada et al.

(10) Patent No.: US 8,834,139 B2
(45) Date of Patent: Sep. 16, 2014

(54) LUBRICATION OF A SCROLL COMPRESSOR

(75) Inventors: Sadayuki Yamada, Shiga (JP); Nobuaki Ogawa, Shiga (JP); Yoshifumi Abe, Shiga (JP); Atsushi Sakuda, Shiga (JP); Takashi Morimoto, Kyoto (JP)

(73) Assignee: Panasonic Corporation, Osaka (JP)

( * ) Notice: Subject to any disclaimer, the term of this patent is extended or adjusted under 35 U.S.C. 154(b) by 757 days.

(21) Appl. No.: 13/122,283

(22) PCT Filed: Jan. 28, 2010

(86) PCT No.: PCT/JP2010/000502

§ 371 (c)(1),
(2), (4) Date: Apr. 28, 2011

(87) PCT Pub. No.: WO2010/087179

PCT Pub. Date: Aug. 5, 2010

(65) Prior Publication Data

US 2011/0194965 A1 Aug. 11, 2011

(30) Foreign Application Priority Data

| | | |
|---|---|---|
| Jan. 30, 2009 | (JP) | 2009-019169 |
| May 28, 2009 | (JP) | 2009-128477 |
| Dec. 3, 2009 | (JP) | 2009-275135 |

(51) Int. Cl.

| | |
|---|---|
| ***F01C 1/02*** | (2006.01) |
| ***F04C 18/02*** | (2006.01) |
| ***F04C 29/02*** | (2006.01) |
| ***F04C 27/00*** | (2006.01) |
| *F04C 28/26* | (2006.01) |

(52) U.S. Cl.

CPC ..... *F04C 18/0215* (2013.01); *F04C 18/0261* (2013.01); *F04C 29/023* (2013.01); *F04C 2240/60* (2013.01); *F04C 27/005* (2013.01); *F04C 28/265* (2013.01); *F04C 27/007* (2013.01); *F04C 29/021* (2013.01)

USPC ..... 418/55.6

(58) Field of Classification Search

CPC ..... F04C 29/021; F04C 29/023

USPC ..... 418/55.6

See application file for complete search history.

(56) References Cited

U.S. PATENT DOCUMENTS 5,370,513 A 12/1994 Fain (Continued)

FOREIGN PATENT DOCUMENTS

| | | |
|---|---|---|
| DE | 3521253 | 12/1986 |
| JP | 56-165788 | 12/1981 |
| JP | 59-185892 | 10/1984 |
| JP | 06-002686 | 1/1994 |
| JP | 2002-310076 | 10/2002 |
| JP | 2003-214448 | 7/2003 |
| JP | 2004-225644 | 8/2004 |

(Continued)

OTHER PUBLICATIONS

Kono et al, Machine translation of Japanese Patent Publication, JP 2006-226246, published in Japanese on Aug. 31, 2006.*

*Primary Examiner* — Mary A Davis

(74) *Attorney, Agent, or Firm* — Hamre, Schumann, Mueller & Larson, P.C.

(57) ABSTRACT

The present invention provides a scroll compressor in which the reliabilities of the eccentric ball bearing and the main ball bearing are enhanced by controlling an amount of oil supplied from the high pressure region to the back pressure chamber and an amount of oil from the high pressure region to the eccentric ball bearing and the main ball bearing. The scroll compressor includes a back pressure chamber oil-supply path 25 through which lubricating oil 7 is supplied from the high pressure region 21 to the back pressure chamber 22, and a compression chamber oil-supply path 26 through which lubricating oil 7 is supplied from the back pressure chamber 22 to the compression chamber, and the one opening 25*c* of the back pressure chamber oil-supply path 25 reciprocates, and comes into and comes out from the sealing member 24.

9 Claims, 8 Drawing Sheets

(56) References Cited

U.S. PATENT DOCUMENTS

| | | | | |
|---|---|---|---|---|
| 6,074,186 | A * | 6/2000 | Lifson et al. | 418/55.6 |
| 6,139,295 | A * | 10/2000 | Utter et al. | 418/55.6 |
| 2004/0265159 | A1* | 12/2004 | Furusho et al. | 418/55.6 |
| 2005/0232800 | A1* | 10/2005 | Kammhoff et al. | 418/55.6 |
| 2010/0092321 | A1* | 4/2010 | Kim et al. | 418/55.6 |

FOREIGN PATENT DOCUMENTS

| | | |
|---|---|---|
| JP | 2004-301054 | 10/2004 |
| JP | 2004-301092 | 10/2004 |
| JP | 2006-226246 | 8/2006 |
| JP | 2007-132256 | 5/2007 |
| JP | 2008-014283 | 1/2008 |

* cited by examiner

LUBRICATION OF A SCROLL COMPRESSOR

TECHNICAL FIELD

The present invention relates to a scroll compressor used for a cooling apparatus such as a cooling and heating air conditioner and a refrigerator, and for a heat pump hot water supply apparatus.

BACKGROUND TECHNIQUE

Conventionally, many manufacturers filed various similar patent applications relating to this kind of scroll compressor, and various compressors are actually utilized as compressors for domestic room air conditioners and compressors for refrigerators. Recently, the scroll compressors begin to be utilized as compressors for vehicular air conditioners.

To lubricate a compressing mechanism of the compressor, there is a method for always supplying oil under a predetermined limitation by providing a narrowed portion in a back pressure chamber oil-supply path formed in an orbiting scroll as disclosed in patent document 1 for example.

PRIOR ART DOCUMENT

[Patent Document 1] Japanese Patent Application Laid-open No. 2008-14283

However, the conventional configuration has a problem that since oil is always supplied from a high pressure region to the back pressure chamber through the narrowed portion of the back pressure chamber oil-supply path, an amount of oil supplied from the high pressure region to a main ball bearing through an eccentric ball bearing is reduced, and reliabilities of the eccentric ball bearing and the main ball bearing are deteriorated.

SUMMARY OF THE INVENTION

The present invention has been accomplished to solve the conventional problem, and it is an object of the invention to enhance the reliabilities of the eccentric ball bearing and the main ball bearing by controlling an amount of oil supplied from the high pressure region to the back pressure chamber and an amount of oil supplied from the high pressure region to the eccentric ball bearing and the main ball bearing.

Means for Solving the Problem

A first aspect of the present invention provides a scroll compressor in which a motor and a compressing mechanism are accommodated in a container, the compressing mechanism comprises an orbiting scroll formed by uprightly standing a spiral lap on a panel, a fixed scroll which is combined with the orbiting scroll and which is formed by uprightly standing a spiral lap on a panel, and a main bearing member which has the orbiting scroll disposed between the fixed scroll and the main bearing member and which holds a sealing member, a compression chamber is formed between the orbiting scroll and the fixed scroll, the sealing member is disposed on a back surface of the orbiting scroll, and the sealing member defines an inner side of the sealing member into a high pressure region and defines an outer side of the sealing member into a back pressure chamber, wherein the scroll compressor includes a back pressure chamber oil-supply path through which lubricating oil is supplied from the high pressure region to the back pressure chamber, and a compression chamber oil-supply path through which lubricating oil is supplied from the back pressure chamber to the compression chamber, and one of openings of the back pressure chamber oil-supply path reciprocates and comes into and comes out from the sealing member.

According to a second aspect, in the scroll compressor of the first aspect, the compression chamber with which a compression chamber-side opening of the compression chamber oil-supply path is in communication is a compression chamber after working fluid is trapped.

According to a third aspect, in the scroll compressor of the first or second aspect, the compression chamber oil-supply path includes a passage formed in the orbiting scroll, and a recess formed in the panel of the fixed scroll, one of openings of the passage is periodically superposed on the recess in accordance with orbiting motion of the orbiting scroll, thereby intermittently bringing the back pressure chamber and the compression chamber into communication with each other.

According to a fourth aspect, in the scroll compressor of any one of the first to third aspects, the high pressure region is provided with a drive shaft oil-supply path having an opening.

According to a fifth aspect, in the scroll compressor of the fourth aspect, the opening of the drive shaft oil-supply path is located in the vicinity of an eccentric ball bearing.

According to a sixth aspect, in the scroll compressor of the fourth or fifth aspect, the opening of the drive shaft oil-supply path is located in the vicinity of a main ball bearing.

According to a seventh aspect, in the scroll compressor of any one of the fourth to sixth aspects, the drive shaft oil-supply path is inclined with respect to an axial direction of a drive shaft.

According to an eighth aspect, in the scroll compressor of the seventh aspect, an end of the drive shaft on a side of the orbiting scroll includes an eccentric shaft, a portion of the drive shaft at a boundary between the eccentric shaft and the drive shaft is notched by a flat surface having an angle with respect to the axial direction of the drive shaft, and the opening of the drive shaft oil-supply path is formed in the flat surface.

According to a ninth aspect, in the scroll compressor of the sixth aspect, the main ball bearing has a shield.

According to a tenth aspect, in the scroll compressor of the ninth aspect, a material of the shield of the main ball bearing is a stainless steel plate.

According to an eleventh aspect, in the scroll compressor of any one of the first to tenth aspects, the scroll compressor is disposed horizontally by a mounting leg provided on the container.

According to a twelfth aspect, the scroll compressor of any one of the first to third aspects further comprises a drive shaft driven by the motor, an oil-supply path formed in the drive shaft, an eccentric shaft formed on one end of the drive shaft, and a cylindrical boss portion formed on the back surface of the orbiting scroll, wherein the eccentric shaft is supported by the cylindrical boss portion through an eccentric ball bearing, the drive shaft is supported by the main bearing member through a main ball bearing, the high pressure region includes a first high pressure region surrounded by an inner portion of the cylindrical boss portion and the eccentric ball bearing, and a second high pressure region surrounded by the main bearing member, an outer portion of the cylindrical boss portion, the eccentric ball bearing and the main ball bearing, an outlet of the oil-supply path is in communication with the first high pressure region, the other opening of the back pressure chamber oil-supply path is in communication with the first high pressure region, the one opening of the back pressure chamber oil-supply path is in communication with the second high pressure region at a location inside of the sealing member, and is in communication with the back pressure chamber at a location outside of the sealing member.

According to a thirteenth aspect, the scroll compressor of the fourth aspect further comprises a drive shaft driven by the motor, an oil-supply path formed in the drive shaft for supplying lubricating oil to the drive shaft oil-supply path, an eccentric shaft formed on one end of the drive shaft, and a cylindrical boss portion formed on the back surface of the orbiting scroll, wherein the eccentric shaft is supported by the cylindrical boss portion through an eccentric ball bearing, the drive shaft is supported by the main bearing member through a main ball bearing, the high pressure region includes a first high pressure region surrounded by an inner portion of the cylindrical boss portion and the eccentric ball bearing, and a second high pressure region surrounded by the main bearing member, an outer portion of the cylindrical boss portion, the eccentric ball bearing and the main ball bearing, an opening of the drive shaft oil-supply path is in communication with the second high pressure region, the other opening of the back pressure chamber oil-supply path is in communication with the first high pressure region, the one opening of the back pressure chamber oil-supply path is in communication with the second high pressure region at a location inside of the sealing member, and is in communication with the back pressure chamber at a location outside of the sealing member.

According to the scroll compressor of the present invention, since it is possible to control the supply of a very small amount of oil from the high pressure region to the back pressure chamber, it is possible to increase the amount of oil supplied to the eccentric ball bearing and the main ball bearing, and reliabilities of the eccentric ball bearing and the main ball bearing are enhanced.

BEST MODE FOR CARRYING OUT THE INVENTION

Figure 1:
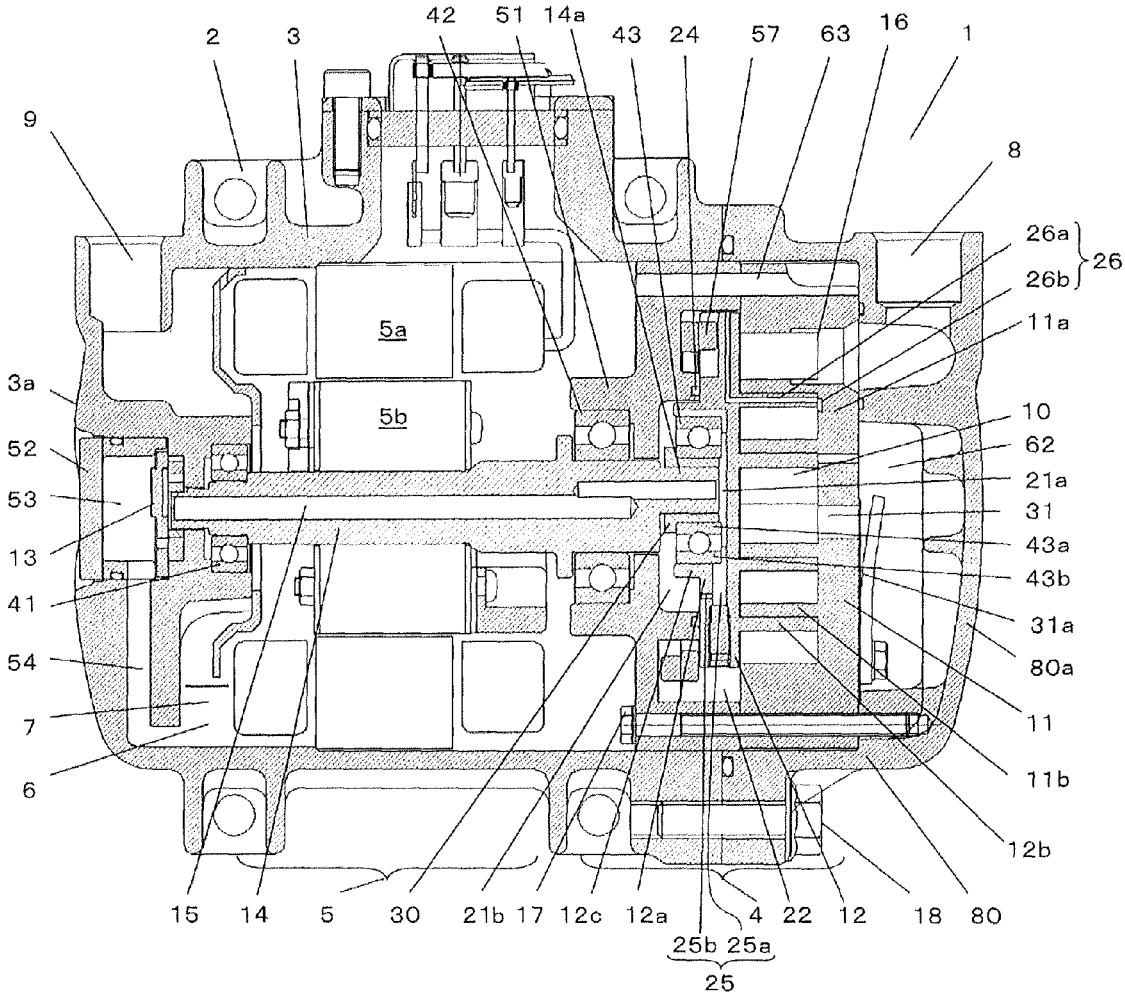
FIG. 1 is a sectional view of a scroll compressor according to a first embodiment of the present invention.

According to the scroll compressor of the first aspect, the scroll compressor includes a back pressure chamber oil-supply path through which lubricating oil is supplied from the high pressure region to the back pressure chamber, and a compression chamber oil-supply path through which lubricating oil is supplied from the back pressure chamber to the compression chamber, and one of openings of the back pressure chamber oil-supply path reciprocates and comes into and comes out from the sealing member. According to this configuration, it is possible to control an amount of oil supplied to the back pressure chamber by a ratio of the one opening of the back pressure chamber oil-supply path reciprocating through the sealing member. Therefore, it is possible to control the supply operation of a very small amount of oil, and excessive supply can be avoided. According to this, it is possible to increase the amount of oil supplied to the eccentric ball bearing and the main ball bearing, and reliabilities of the eccentric ball bearing and the main ball bearing are enhanced. Since it is unnecessary to make a diameter of the back pressure chamber oil-supply path small, it is possible to prevent the back pressure chamber oil-supply path from being occluded by a foreign matter, and a stable back pressure can be maintained.

According to the second aspect, especially in the scroll compressor of the first aspect, the compression chamber with which a compression chamber-side opening of the compression chamber oil-supply path is in communication is a compression chamber after working fluid is trapped. According to this configuration, it is possible to avoid a so-called tilting phenomenon in which the orbiting scroll separates from the fixed scroll and ability is deteriorated. Even if the tilting is generated, since it is possible to guide a pressure in the compression chamber into the back pressure chamber, the operation state can soon return to the normal operation.

According to the third aspect, especially in the scroll compressor of the first or second aspects, the compression chamber oil-supply path includes a passage formed in the orbiting scroll, and a recess formed in the panel of the fixed scroll, one of openings of the passage is periodically superposed on the recess in accordance with orbiting motion of the orbiting scroll, thereby intermittently bringing the back pressure chamber and the compression chamber into communication with each other. According to this configuration, it is possible to suppress a pressure variation in the back pressure chamber and to control the pressure to a predetermined value by intermittently bringing the back pressure chamber and the compression chamber into communication with each other.

According to the fourth aspect, especially in the scroll compressor of any one of the first to third aspects, the high pressure region is provided with a drive shaft oil-supply path having an opening. According to this configuration, the drive shaft oil-supply path opens at the high pressure region of the panel back surface of the orbiting scroll. Therefore, it is possible to increase the amount of oil supplied to the eccentric ball bearing and the main ball bearing, and the reliabilities of the eccentric ball bearing and the main ball bearing are enhanced. Lubricating oil is supplied from the back pressure chamber oil-supply path to the back pressure chamber through the eccentric ball bearing by a pressure difference between the high pressure region and the back pressure chamber. According to this, oil can stably be supplied to the eccentric ball bearing, and the reliability of the eccentric ball bearing is further enhanced.

According to the fifth aspect, especially in the scroll compressor of the fourth aspect, the opening of the drive shaft oil-supply path is located in the vicinity of an eccentric ball bearing. According to this configuration, it is possible to increase the amount of oil supplied to the eccentric ball bearing, and the reliability of the eccentric ball bearing is enhanced.

According to the sixth aspect, especially in the scroll compressor of the fourth aspect, the opening of the drive shaft oil-supply path is located in the vicinity of a main ball bearing. According to this configuration, it is possible to increase the amount of oil supplied to the main ball bearing, and the reliability of the main ball bearing is enhanced.

According to the seventh aspect, especially in the scroll compressor of any one of the fourth to sixth aspect, the drive shaft oil-supply path is inclined with respect to an axial direction of a drive shaft. According to this configuration, it is possible to supply lubricating oil to many locations as the drive shaft rotates.

According to the eighth aspect, especially in the scroll compressor of the seventh aspect, an end of the drive shaft on a side of the orbiting scroll includes an eccentric shaft, a portion of the drive shaft at a boundary between the eccentric shaft and the drive shaft is notched by a flat surface having an angle with respect to the axial direction of the drive shaft, and the opening of the drive shaft oil-supply path is formed in the flat surface. According to this configuration, it becomes easy to machine the drive shaft oil-supply path.

According to the ninth aspect, especially in the scroll compressor of the sixth aspect, the main ball bearing has a shield. According to this configuration, the drive shaft oil-supply path opens at the high pressure region of the panel back surface of the orbiting scroll, lubricating oil lubricates the main ball bearing, and the main ball bearing has the shield. Therefore, it is possible to prevent lubricating oil from flowing out toward the motor, lubricating oil is supplied from the back pressure chamber oil-supply path to the back pressure chamber through the eccentric ball bearing by a pressure difference, it is possible to increase the amount of oil supplied to the eccentric ball bearing and the main ball bearing, and reliabilities of the eccentric ball bearing and the main ball bearing are enhanced.

According to the tenth aspect, especially in the scroll compressor of the ninth aspect, a material of the shield of the main ball bearing is a stainless steel plate. According to this, the strength of the shield is enhanced, and reliability of the main ball bearing is enhanced.

According to the eleventh aspect, especially in the scroll compressor of any one of the first to tenth aspects, the scroll compressor is disposed horizontally by a mounting leg provided on the container. According to this According to this configuration, lubricating oil which flowed out from the compressing mechanism is not stirred by the motor, and is collected into the liquid reservoir and therefore, lubricating oil can be secured and reliability is enhanced.

According to the twelfth, especially in the scroll compressor of any one of the first to third aspects, the scroll compressor further comprises a drive shaft driven by the motor, an oil-supply path formed in the drive shaft, an eccentric shaft formed on one end of the drive shaft, and a cylindrical boss portion formed on the back surface of the orbiting scroll, wherein the eccentric shaft is supported by the cylindrical boss portion through an eccentric ball bearing, the drive shaft is supported by the main bearing member through a main ball bearing, the high pressure region includes a first high pressure region surrounded by an inner portion of the cylindrical boss portion and the eccentric ball bearing, and a second high pressure region surrounded by the main bearing member, an outer portion of the cylindrical boss portion, the eccentric ball bearing and the main ball bearing, an outlet of the oil-supply path is in communication with the first high pressure region, the other opening of the back pressure chamber oil-supply path is in communication with the first high pressure region, the one opening of the back pressure chamber oil-supply path is in communication with the second high pressure region at a location inside of the sealing member, and is in communication with the back pressure chamber at a location outside of the sealing member. According to this configuration, lubricating oil supplied from the oil-supply path is supplied to the eccentric ball bearing, a portion of the lubricating oil supplied to the eccentric ball bearing is intermittently guided to the back pressure chamber, and lubricating oil can reliably be supplied also to the main ball bearing.

According to the thirteenth aspect, especially in the scroll compressor of the fourth aspect, the scroll compressor further comprises a drive shaft driven by the motor, an oil-supply path formed in the drive shaft for supplying lubricating oil to the drive shaft oil-supply path, an eccentric shaft formed on one end of the drive shaft, and a cylindrical boss portion formed on the back surface of the orbiting scroll, wherein the eccentric shaft is supported by the cylindrical boss portion through an eccentric ball bearing, the drive shaft is supported by the main bearing member through a main ball bearing, the high pressure region includes a first high pressure region surrounded by an inner portion of the cylindrical boss portion and the eccentric ball bearing, and a second high pressure region surrounded by the main bearing member, an outer portion of the cylindrical boss portion, the eccentric ball bearing and the main ball bearing, an opening of the drive shaft oil-supply path is in communication with the second high pressure region, the other opening of the back pressure chamber oil-supply path is in communication with the first high pressure region, the one opening of the back pressure chamber oil-supply path is in communication with the second high pressure region at a location inside of the sealing member, and is in communication with the back pressure chamber at a location outside of the sealing member. According to this configuration, lubricating oil supplied from the oil-supply path can reliably be supplied to the eccentric ball bearing and the main ball bearing, and a portion of lubricating oil supplied to the high pressure region can intermittently be guided to the back pressure chamber.

PREFERRED EMBODIMENTS

First Embodiment

Embodiments of the present invention will be described with reference to the drawings. It should be noted that the invention is not limited to the embodiments.

First Embodiment

Figure 2:
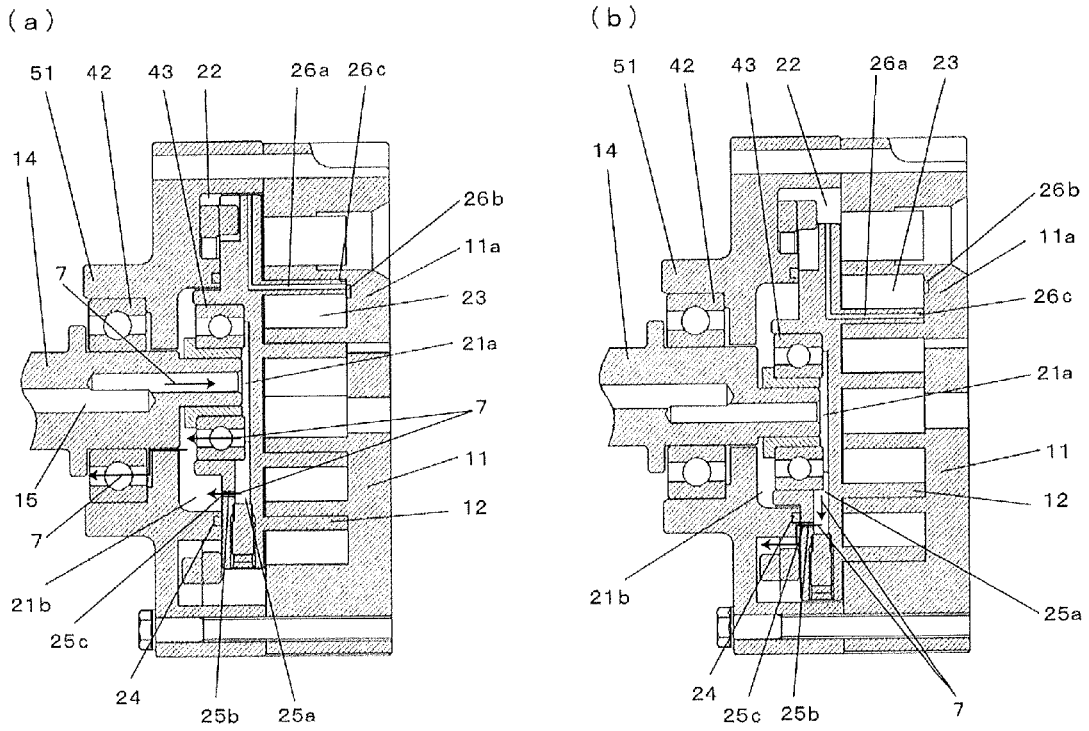
FIG. 2 are enlarged sectional views of an essential portion showing operation of a compressing mechanism of the scroll compressor.
Figure 3:
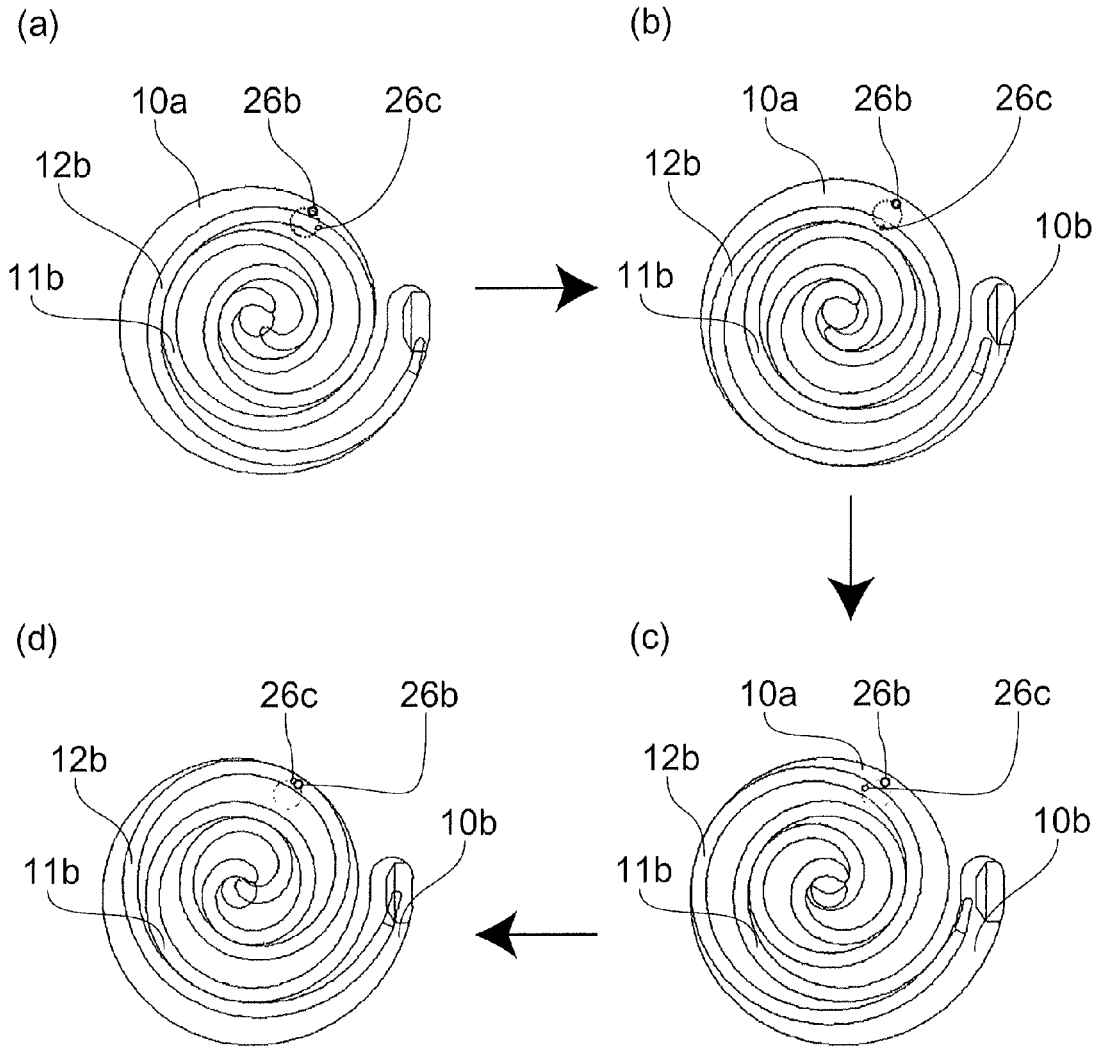
FIG. 3 are sectional views of an essential portion showing a combined state of an orbiting scroll and a fixed scroll of the scroll compressor.
Figure 4:
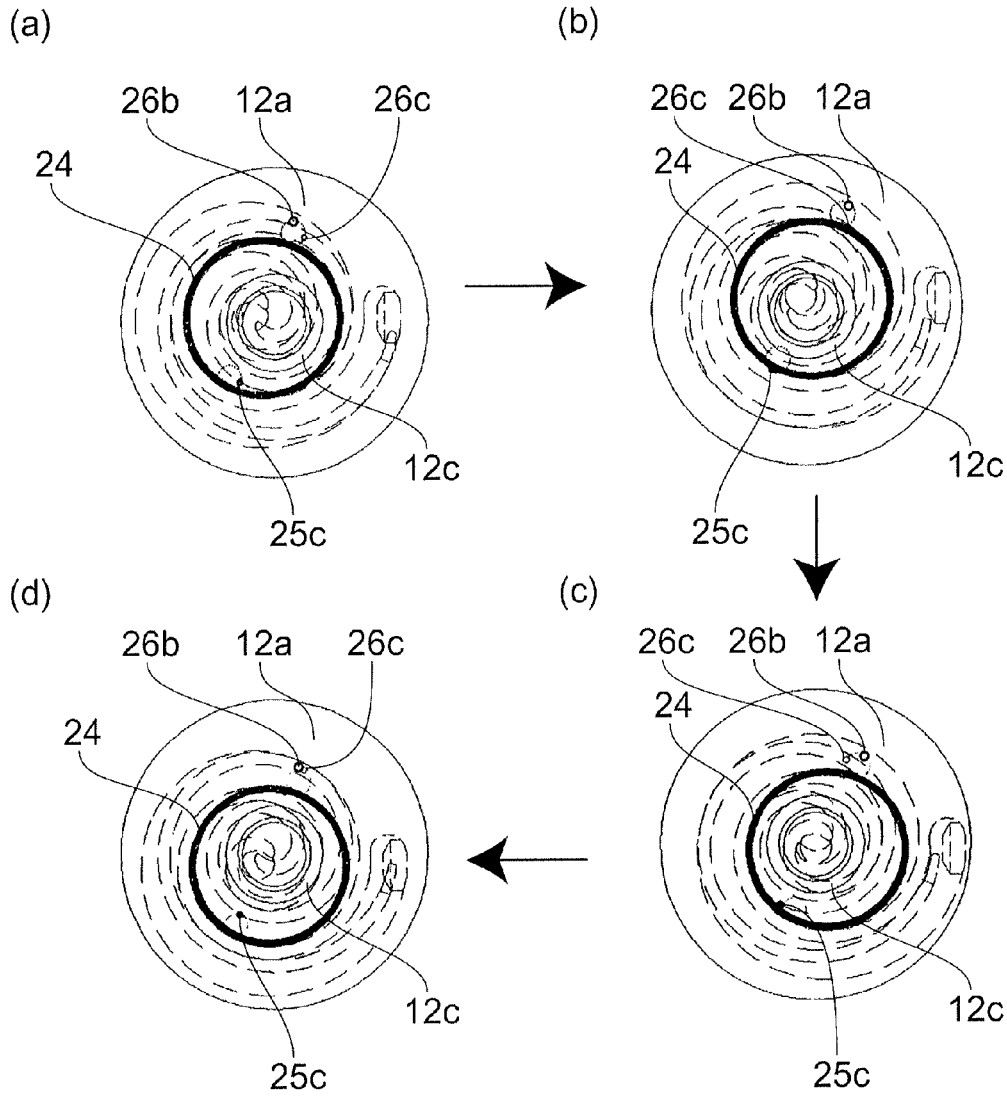
FIG. 4 are plan views of an essential portion showing a back surface of the orbiting scroll of the scroll compressor.

FIG. 1 is a sectional view of a scroll compressor according to a first embodiment of the present invention. FIG. 2 are enlarged sectional views of an essential portion of a compressing mechanism shown in FIG. 1. FIG. 3 are sectional views of an essential portion showing a combined state of an orbiting scroll and a fixed scroll of the scroll compressor. FIG. 4 are plan views of an essential portion showing a back surface of the orbiting scroll of the scroll compressor.

FIG. 1 shows a horizontal scroll compressor 1 which is horizontally disposed by a mounting leg 2. The mounting leg 2 is provided around a barrel portion of the scroll compressor 1. The scroll compressor 1 has a body casing 3, and a compressing mechanism 4 and a motor 5 which drives the compressing mechanism 4 are accommodated in the body casing 3. The scroll compressor 1 includes a liquid reservoir 6 in which lubricating oil 7 is stored. The motor 5 is driven by a motor-driving circuit (not shown). Working fluid which is handled is gas refrigerant, the lubricating oil 7 lubricates various sliding portions, and is used as seal of the sliding portions of the compressing mechanism 4. The lubricating oil 7 which is compatible with respect to refrigerant is used. However, the invention is not limited to them. Basically, the invention is not limited to the following description only if the compressing mechanism 4 which sucks, compresses and discharges working fluid, the motor 5 which drives the compressing mechanism 4, and the liquid reservoir 6 in which liquid for lubricating the various sliding portion including the compressing mechanism 4 are accommodated in the body casing 3 and the motor 5 is driven by the motor-driving circuit.

The compressing mechanism 4 includes an orbiting scroll 12, a fixed scroll 11 and a main bearing member 51. The orbiting scroll 12 is formed by uprightly standing a spiral lap 12*b* on a panel 12*a*. The fixed scroll 11 is combined with the orbiting scroll 12. The fixed scroll 11 is formed by uprightly standing a spiral lap 11*b* on a panel 11*a*. The orbiting scroll 12 is disposed between the fixed scroll 11 and the main bearing member 51, and the main bearing member 51 holds a sealing member 24.

A suction port 16 is formed in an outer periphery of the panel 11*a* of the fixed scroll 11, and a discharge port 31 is formed in a central portion of the panel 11*a*. A cylindrical boss portion 12*c* is formed on a back surface of the orbiting scroll 12.

An eccentric shaft 14*a* is integrally formed on one end of a drive shaft 14. The eccentric shaft 14*a* is supported by the cylindrical boss portion 12*c* through an eccentric ball bearing 43. A bush 30 is attached to the eccentric shaft 14*a*. An inner race 43*a* of the eccentric ball bearing 43 is fitted over the bush 30, an outer race 43*b* of the eccentric ball bearing 43 is loosely fitted into the cylindrical boss portion 12*c* with a slight gap therebetween. One end of the drive shaft 14 is supported by the main bearing member 51 through a main ball bearing 42.

The sealing member 24 is disposed on a back surface of the panel 12*a* of the orbiting scroll 12. The back surface of the panel 12*a* of the orbiting scroll 12 is defined by the sealing member 24 such that an inner side of the sealing member 24 forms a high pressure region 21 and an outer side of the sealing member 24 forms a back pressure chamber 22.

The high pressure region 21 includes a first high pressure region 21*a* surrounded by an interior of the cylindrical boss portion 12*c* and the eccentric ball bearing 43, and a second high pressure region 21*b* surrounded by the main bearing member 51, an exterior of the cylindrical boss portion 12*c*, the eccentric ball bearing 43 and the main ball bearing 42. An oil reservoir is formed in a lower portion of the second high pressure region 21*b*.

A back pressure chamber oil-supply path 25 is formed in the panel 12*a* of the orbiting scroll 12. The back pressure chamber oil-supply path 25 supplies lubricating oil from the high pressure region 21 to the back pressure chamber 22. The back pressure chamber oil-supply path 25 includes a first back pressure chamber oil-supply path 25*a* which is in communication with the first high pressure region 21*a*, and a second back pressure chamber oil-supply path 25*b* having one of openings 25*c* which reciprocates, and comes into and comes out from the sealing member 24. The first back pressure chamber oil-supply path 25*a* and the second back pressure chamber oil-supply path 25*b* are in communication with each other.

A compression chamber oil-supply path 26 includes a passage 26*a* formed in the orbiting scroll 12, and a recess 26*b* formed in the panel 11*a* of the fixed scroll 11. Lubricating oil is supplied from the back pressure chamber 22 to the compression chamber 10. A compression chamber-side opening 26*c* of the passage 26*a* is formed in a tooth tip of the spiral lap 12*b* of the orbiting scroll 12, and the compression chamber-side opening 26*c* is periodically superposed on the recess 26*b* in accordance with orbiting motion of the orbiting scroll 12, thereby intermittently bringing the back pressure chamber 22 and the compression chamber 10 into communication with each other.

The compression chamber 10 is formed by meshing the spiral lap 11*b* of the fixed scroll 11 and the spiral lap 12*b* of the orbiting scroll 12 with each other, and when the orbiting scroll 12 is made to orbit with respect to the fixed scroll 11, capacity of the compression chamber 10 is varied in accordance with movement. Refrigerant gas which comes back from an external cycle is sucked by the compression chamber 10 from the suction port 16, and refrigerant gas which is compressed in the compression chamber 10 is discharged from the discharge port 31 into a discharge chamber 62.

A discharge port 9 is formed in the body casing 3, and compressed refrigerant gas is discharged through the discharge port 9. A suction port 8 is formed in a sub-casing 80, and refrigerant gas which is to be compressed is sucked through the suction port 8. The body casing 3 and the sub-casing 80 constitute a container.

In the scroll compressor 1, a pump 13, an auxiliary ball bearing 41, the motor 5 and the main bearing member 51 which includes the main ball bearing 42 are disposed in this order from a side of one end wall 3*a* in an axial direction in the body casing 3. The pump 13 is accommodated from an outer surface of the end wall 3*a*, and the pump 13 is fitted and fixed by a lid body 52. A pump chamber 53 is formed inside of the lid body 52, and the pump chamber 53 is in communication with the liquid reservoir 6 through a pumping passage 54. The auxiliary ball bearing 41 is supported by the end wall 3*a*, and a side of the drive shaft 14 which is connected to the pump 13 is rotatably supported by the auxiliary ball bearing 41. The motor 5 includes a stator 5*a* and a rotor 5*b*, and rotates the drive shaft 14. The stator 5*a* is fixed to an inner periphery of the body casing 3 by shrink fitting, and the rotor 5*b* is fixed to the drive shaft 14.

The main bearing member 51 is fixed to an inner periphery of the sub-casing 80 by a bolt 17, and the drive shaft 14 on the side of the compressing mechanism 4 is rotatably supported by the main ball bearing 42. The fixed scroll 11 is mounted on an outer surface of the main bearing member 51 through a bolt (not shown), and the orbiting scroll 12 is sandwiched between the main bearing member 51 and the fixed scroll 11. An Oldham-ring 57 which prevents the orbiting scroll 12 from rotating and which makes the orbiting scroll 12 orbit is provided between the main bearing member 51 and the orbiting scroll 12.

A portion of the compressing mechanism 4 which is exposed from the sub-casing 80 is covered with the body casing 3. An end wall 80*a* is formed on the sub-casing 80 on a side opposite from the end wall 3*a* in its axial direction. The openings of the body casing 3 and the sub-casing 80 are butted with each other and the body casing 3 and the sub-casing 80 are fixed to each other through a bolt 18. The compressing mechanism 4 is located between the suction port 8 of the sub-casing 80 and the discharge port 9 of the body casing 3. The suction port 16 of the fixed scroll 11 is connected to the suction port 8 of the sub-casing 80, and the discharge port 31 of the fixed scroll 11 is connected to the discharge chamber 62 through a reed valve 31*a*. The discharge chamber 62 is in communication with a space on the side of the motor 5 through a communication passage 63 formed in the fixed scroll 11 and the main bearing member 51. The communication passage 63 may be formed between the fixed scroll 11, the main bearing member 51 and the body casing 3.

The motor 5 is driven by the motor-drive circuit, the motor 5 makes the compressing mechanism 4 orbit through the drive shaft 14, and drives the pump 13. At that time, lubricating oil 7 in the liquid reservoir 6 is supplied to the compressing mechanism 4 by the pump 13, and the compressing mechanism 4 is lubricated and sealed. Refrigerant gas discharged into the discharge chamber 62 passes through the motor 5 from the communication passage 63, cools the motor 5, and is discharged from the discharge port 9 of the body casing 3. The lubricating oil 7 included in the refrigerant gas in the container separates from the refrigerant gas by colliding and narrowing effects, and the lubricating oil 7 lubricates the auxiliary ball bearing 41.

Lubricating oil 7 stored in the liquid reservoir 6 of the body casing 3 is supplied to an oil-supply passage 15 formed in the drive shaft 14 by driving the pump 13 by the drive shaft 14. An outlet of the oil-supply passage 15 is formed in an end of the eccentric shaft 14*a*. The lubricating oil 7 may be supplied to the oil-supply passage 15 utilizing a pressure difference in the body casing 3 instead of the driving operation of the pump 13.

Flow of lubricating oil 7 in the compressing mechanism 4 will be described using FIG. 2.

As the orbiting scroll 12 orbits, lubricating oil 7 is supplied from the oil-supply passage 15 to the first high pressure region 21*a*.

In a state shown in FIG. 2(*a*), the one opening 25*c* of the back pressure chamber oil-supply path 25 is located on the side of the high pressure region 21 with respect to the sealing member 24, and lubricating oil 7 is not supplied to the back pressure chamber 22.

In this state, a portion of the lubricating oil 7 supplied to the first high pressure region 21*a* is supplied to the second high pressure region 21*b* through the eccentric ball bearing 43. Another portion of the lubricating oil 7 supplied to the first high pressure region 21*a* is supplied from the first high pressure region 21*a* to the second high pressure region 21*b* because the one opening 25*c* of the second back pressure chamber oil-supply path 25*b* is located inside of the sealing member 24. In this manner, the lubricating oil 7 supplied to the second high pressure region 21*b* flows out into a space on the side of the motor 5 through the main ball bearing 42, and is collected into the liquid reservoir 6.

In a state shown in FIG. 2(*b*), since the one opening 25*c* of the back pressure chamber oil-supply path 25 is located outside of the sealing member 24, a portion of the lubricating oil 7 supplied to the first high pressure region 21*a* is supplied to the back pressure chamber 22, and a back pressure of the orbiting scroll 12 is backed up.

Further, in the state shown in FIG. 2(*a*), lubricating oil 7 supplied to the back pressure chamber 22 is supplied from the back pressure chamber 22 to the compression chamber 23 by communication between the compression chamber-side opening 26*c* of the compression chamber oil-supply path 26 and the recess 26*b* formed in a lap side surface of the panel 11*a* of the fixed scroll 11, and a space between the fixed scroll 11 and the orbiting scroll 12 is sealed, and they are lubricated. As shown in FIG. 2(*b*), when the compression chamber-side opening 26*c* and the recess 26*b* are not in communication with each other, lubricating oil 7 is not supplied to the compression chamber 23.

FIGS. 3(*a*), (*b*), (*c*) and (*d*) show states where a phase of the orbiting scroll 12 is deviated with respect to the fixed scroll 11 by 90° by 90°.

As shown in the drawings, the recess 26*b* is formed in a compression chamber 10*a* after refrigerant gas which is working fluid is trapped, and the recess 26*b* is not formed in a compression chamber 10*b* before the refrigerant gas is trapped. That is, if the compression chamber 10 with which the back pressure chamber 22 is brought into communication through the compression chamber oil-supply path 26 is made as the compression chamber 10*a* after working fluid is trapped, it is possible to avoid a so-called tilting phenomenon in which the orbiting scroll 12 separates from the fixed scroll 11 and ability is deteriorated. Even if the tilting is generated, since it is possible to guide a pressure in the compression chamber 10 into the back pressure chamber 22, the operation state can soon return to the normal operation.

In the case of the configuration shown in FIG. 3, if the compression chamber-side opening 26*c* is superposed on the recess 26*b* in the state shown in FIG. 3(*d*), lubricating oil 7 is supplied from the back pressure chamber 22 to the compression chamber 10 through the compression chamber oil-supply path 26.

On the other hand, in the states shown in FIGS. 3(*a*), (*b*) and (*c*), since the compression chamber-side opening 26*c* is not superposed on the recess 26*b*, lubricating oil 7 is not supplied from the back pressure chamber 22 to the compression chamber 10.

FIGS. 4(*a*), (*b*), (*c*) and (*d*) show states where the phase is deviated by 90° by 90° like FIG. 3.

As shown in FIG. 4, the sealing member 24 partitions the back surface of the orbiting scroll 12 into the inner side high pressure region 21 and the outer side back pressure chamber 22.

In a state shown in FIG. 4(*b*), since the opening 25*c* opens at the back pressure chamber 22 which is outside of the sealing member 24, lubricating oil 7 is supplied from the high pressure region 21 to the back pressure chamber 22.

In a state shown in FIGS. 4(*a*), (*c*) and (*d*), since the opening 25*c* opens at the high pressure region 21 which is inside of the sealing member 24, lubricating oil 7 is not supplied from the high pressure region 21 to the back pressure chamber 22.

Here, in this embodiment, it is possible to control an amount of oil supplied to the back pressure chamber 22 by a ratio of the one opening 25*c* of the back pressure chamber oil-supply path 25 reciprocating and coming into and coming out from the sealing member 24. Therefore, it is possible to control the supplying operation of a very small amount of oil, and to prevent excessive supply. According to this, it is possible to increase an amount of oil supplied to the eccentric ball bearing 43 and the main ball bearing 42, and the reliabilities of the eccentric ball bearing 43 and the main ball bearing 42 are enhanced. Since it is unnecessary to make a diameter of the back pressure chamber oil-supply path 25 small, it is possible to prevent the back pressure chamber oil-supply path 25 from being occluded by a foreign matter, and to maintain a stable back pressure.

Since the compression chamber 10 with which the compression chamber-side opening 26*c* of the compression chamber oil-supply path 26 of the embodiment is in communication is made as the compression chamber 10*a* after working fluid is trapped, it is possible to avoid the so-called tilting phenomenon in which the orbiting scroll 12 separates from the fixed scroll 11 and ability is deteriorated. Even if the tilting is generated, since it is possible to guide a pressure in the compression chamber 10 into the back pressure chamber 22, the operation state can soon return to the normal operation.

The compression chamber oil-supply path 26 of the embodiment includes the passage 26*a* formed in the orbiting scroll 12 and the recess 26*b* formed in the lap side surface of the panel 11*a* of the fixed scroll 11, and the compression chamber-side opening 26*c* of the passage 26*a* periodically opens at the recess 26*b* in accordance with the orbiting motion. According to this, the back pressure chamber 22 and the compression chamber 10 are intermittently brought into communication with each other, a pressure variation in the back pressure chamber 22 can be suppressed, and it is possible to control the pressure to a predetermined value.

Second Embodiment

Figure 5:
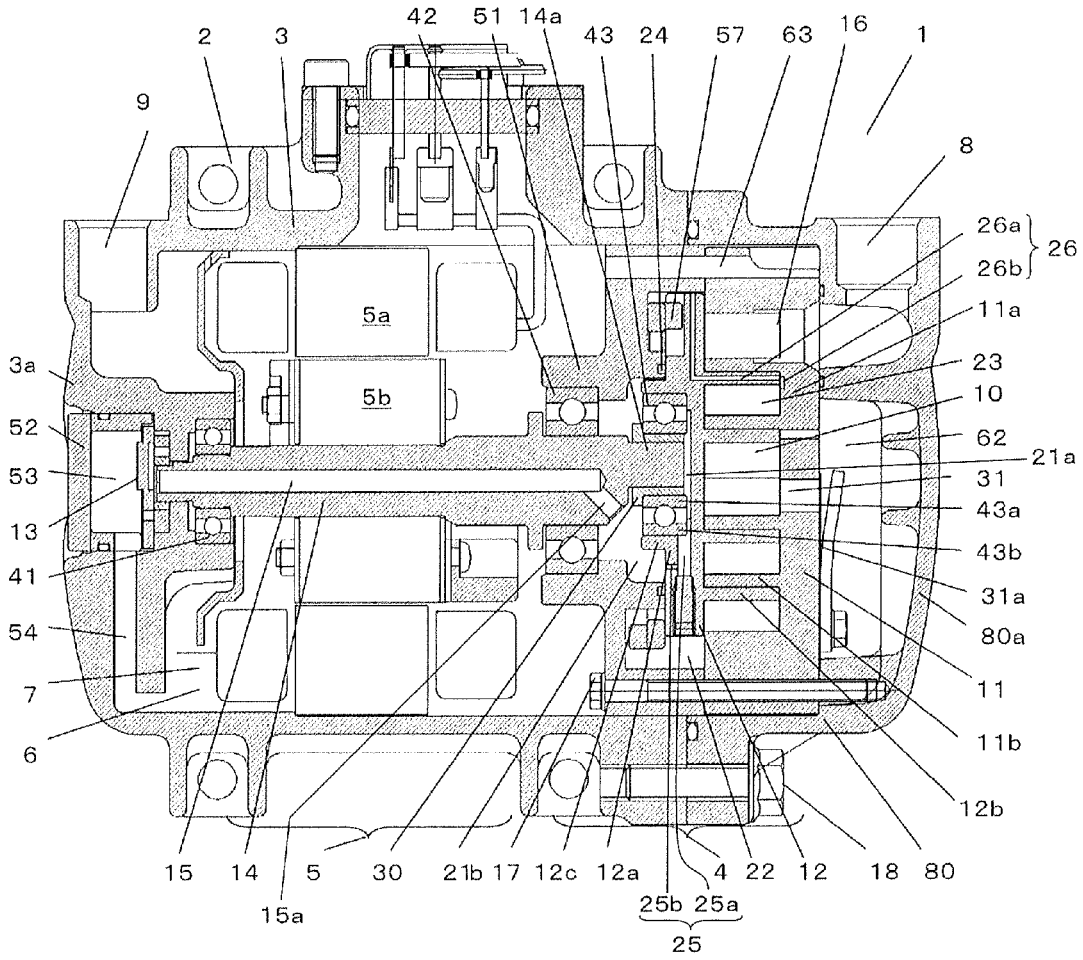
FIG. 5 is a sectional view of a scroll compressor according to a second embodiment of the invention.
Figure 6:
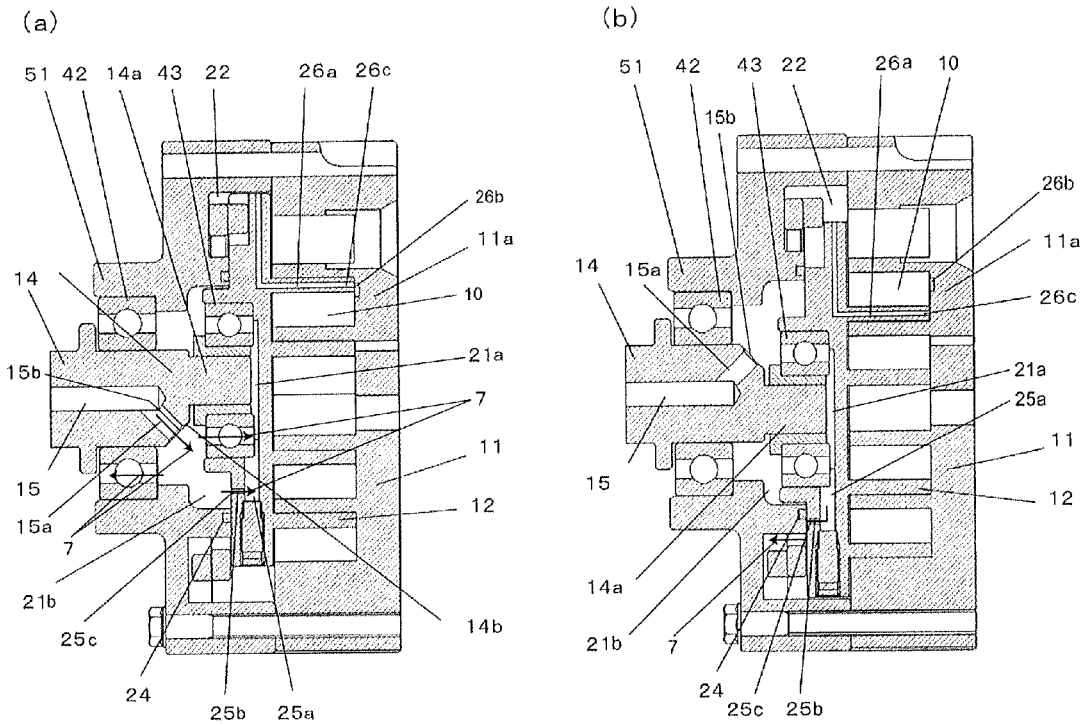
FIG. 6 are enlarged sectional views of an essential portion showing operation of a compressing mechanism of the scroll compressor.

FIG. 5 is a sectional view of a scroll compressor according to a second embodiment of the invention. FIG. 6 are enlarged sectional views of an essential portion showing operation of a compressing mechanism of the scroll compressor. The same configurations as those of the first embodiment are designated with the same symbols, and description thereof will be omitted.

In the second embodiment, the oil-supply passage 15 does not reach the eccentric shaft 14*a*, and an outlet of the oil-supply passage 15 is connected to a drive shaft oil-supply path 15*a*. The drive shaft oil-supply path 15*a* has an angle with respect to an axial direction of the drive shaft 14. A portion of a boundary between the drive shaft 14 and the eccentric shaft 14*a* on the side of the drive shaft 14 is notched by a flat surface 14*b* which is inclined with respect to the axial direction of the drive shaft 14, and an opening 15*b* of the drive shaft oil-supply path 15*a* is formed in the flat surface 14*b*.

Here, flow of lubricating oil 7 in the compressing mechanism 4 will be described using FIG. 6.

As the orbiting scroll 12 orbits, lubricating oil 7 from the oil-supply passage 15 is supplied to the second high pressure region 21*b* through the drive shaft oil-supply path 15*a*.

In a state shown in FIG. 6(*a*), the one opening 25*c* of the back pressure chamber oil-supply path 25 is located on the side of the high pressure region 21 with respect to the sealing member 24, and the lubricating oil 7 is not supplied to the back pressure chamber 22.

In this state, a portion of the lubricating oil 7 supplied to the second high pressure region 21*b* is supplied to the first high pressure region 21*a* through the eccentric ball bearing 43. Another portion of the lubricating oil 7 supplied to the second high pressure region 21*b* is supplied from the second high pressure region 21*b* to the first high pressure region 21*a* because the one opening 25*c* of the second back pressure chamber oil-supply path 25*b* is located inside of the sealing member 24. In this manner, a portion of the lubricating oil 7 supplied to the second high pressure region 21*b* flows out toward a space on the side of the motor 5 through the main ball bearing 42 and is collected into the liquid reservoir 6.

In a state shown in FIG. 6(*b*), since the one opening 25*c* of the back pressure chamber oil-supply path 25 is located outside of the sealing member 24, a portion of the lubricating oil 7 supplied to the first high pressure region 21*a* is supplied to the back pressure chamber 22, and a back pressure of the orbiting scroll 12 is backed up.

In the state shown in FIG. 6(*a*), the lubricating oil 7 supplied to the back pressure chamber 22 is supplied from the back pressure chamber 22 to the compression chamber 23 due to communication between the compression chamber-side opening 26*c* of the compression chamber oil-supply path 26 and the recess 26*b* formed in the lap side surface of the panel 11*a* of the fixed scroll 11, a space between the fixed scroll 11 and the orbiting scroll 12 is sealed, and they are lubricated. As shown in FIG. 6(*b*), when the compression chamber-side opening 26*c* and the recess 26*b* are not in communication with each other, lubricating oil 7 is not supplied to the compression chamber 23.

As described above, according to this embodiment, since the drive shaft oil-supply path 15*a* is in communication with the second high pressure region 21*b*, it is possible to increase an amount of oil supplied to the eccentric ball bearing 43 and the main ball bearing 42, and reliabilities of the eccentric ball bearing 43 and the main ball bearing 42 are enhanced. A portion of the lubricating oil 7 is supplied from the back pressure chamber oil-supply path 25 to the back pressure chamber 22 by a pressure difference between the high pressure region 21 and the back pressure chamber 22. According to this, it is possible to stably supply oil to the eccentric ball bearing 43, and the reliability of the eccentric ball bearing 43 is further enhanced.

The drive shaft oil-supply path 15*a* of this embodiment opens in the vicinity of the eccentric ball bearing 43. Therefore, it is possible to increase an amount of oil supplied to the eccentric ball bearing 43, and the reliability of the eccentric ball bearing 43 is enhanced.

The drive shaft oil-supply path 15*a* of the embodiment opens in the vicinity of the main ball bearing 42, it is possible to increase an amount of oil supplied to the main ball bearing 42, and the reliability of the main ball bearing 42 is enhanced.

A portion of a boundary between the drive shaft 14 and the eccentric shaft 14*a* on the side of the drive shaft is formed on the flat surface 14*b* which is inclined with respect to the drive shaft 14, and an opening 15*b* of the drive shaft oil-supply path 15*a* is formed in the flat surface 14*b*. Therefore, it is possible to easily form the drive shaft oil-supply path 15*a*.

Third Embodiment

Figure 7:
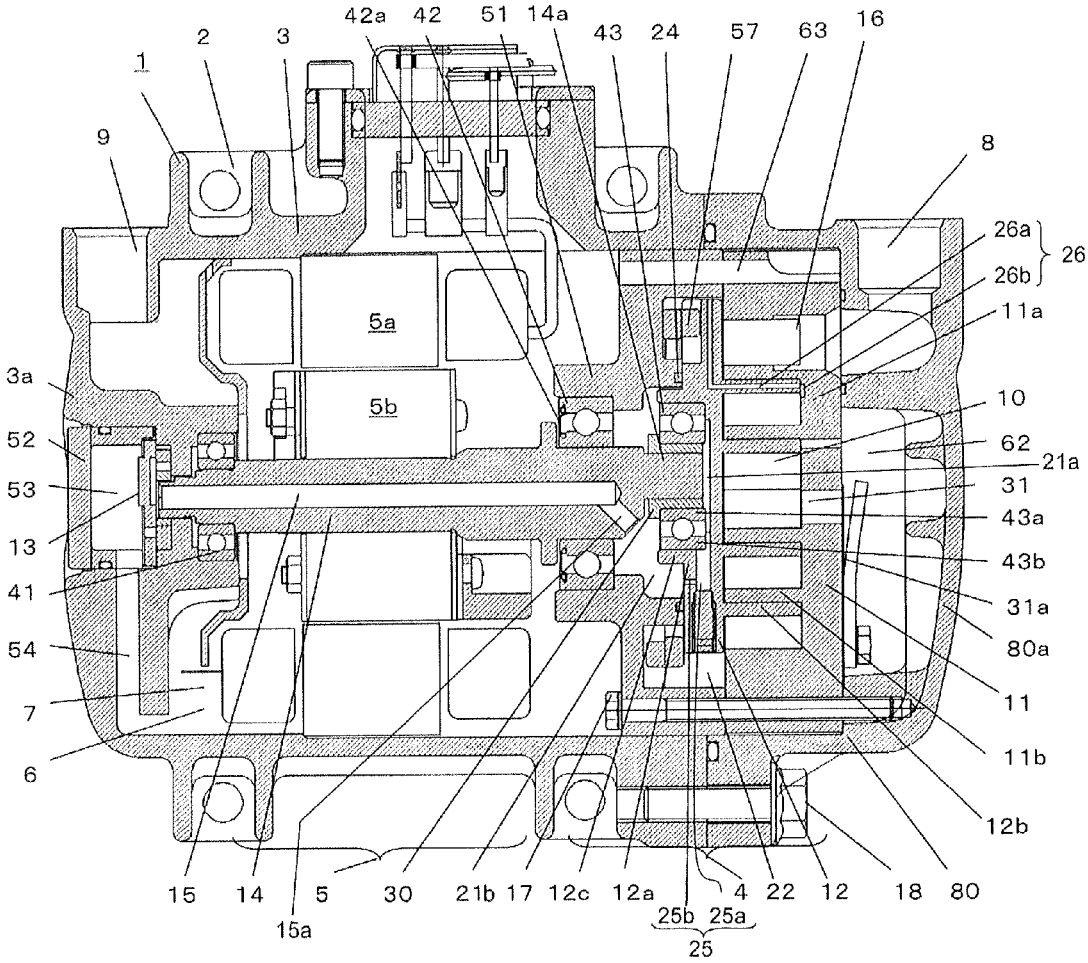
FIG. 7 is a sectional view of a scroll compressor according to a third embodiment of the invention.
Figure 8:
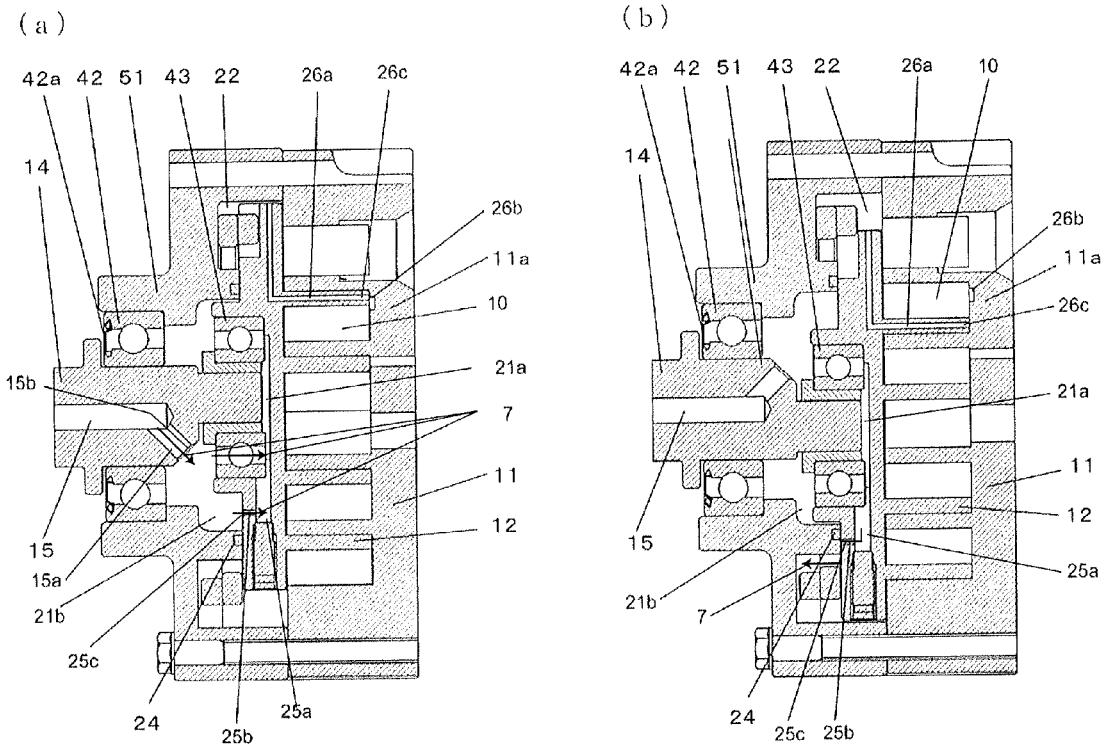
FIG. 8 are enlarged sectional views of an essential portion showing operation of a compressing mechanism of the scroll compressor.

FIG. 7 is a sectional view of a scroll compressor according to a third embodiment of the invention. FIG. 8 are enlarged sectional views of an essential portion of a compressing mechanism shown in FIG. 7. The same configurations as those of the first and second embodiments are designated with the same symbols, and description thereof will be omitted.

According to the third embodiment, in the scroll compressor in the second embodiment, the main ball bearing 42 has a shield. A material of a shield 42*a* is a stainless steel plate.

Here, flow of lubricating oil 7 in the compressing mechanism 4 will be described using FIG. 8.

As the orbiting scroll 12 orbits, lubricating oil 7 from the oil-supply passage 15 is supplied to the second high pressure region 21*b* through the drive shaft oil-supply path 15*a*.

In a state shown in FIG. 8(*a*), the one opening 25*c* of the back pressure chamber oil-supply path 25 is located on the side of the high pressure region 21 with respect to the sealing member 24, and lubricating oil 7 is not supplied to the back pressure chamber 22.

In this state, a portion of lubricating oil 7 supplied to the second high pressure region 21*b* is supplied to the first high pressure region 21*a* through the eccentric ball bearing 43. Another portion of the lubricating oil 7 supplied to the second high pressure region 21*b* is supplied from the second high pressure region 21*b* to the first high pressure region 21*a* because the one opening 25*c* of the second back pressure chamber oil-supply path 25*b* is located inside of the sealing member 24. A portion of the lubricating oil 7 supplied to the second high pressure region 21*b* is also supplied to the main ball bearing 42, but the lubricating oil 7 does not flow out toward a space on the side of the motor 5 due to the shield 42*a*.

In a state shown in FIG. 8(*b*), since the one opening 25*c* of the back pressure chamber oil-supply path 25 is located outside of the sealing member 24, a portion of the lubricating oil 7 supplied to the first high pressure region 21*a* is supplied to the back pressure chamber 22, and a back pressure of the orbiting scroll 12 is backed up.

In the state shown in FIG. 8(*a*), the lubricating oil 7 supplied to the back pressure chamber 22 is supplied to the compression chamber 23 due to communication between the compression chamber-side opening 26*c* of the compression chamber oil-supply path 26 and the recess 26*b* formed in the lap side surface of the panel 11*a* of the fixed scroll 11, a space between the fixed scroll 11 and the orbiting scroll 12 is sealed, and they are lubricated. As shown in FIG. 8(*b*), when the compression chamber-side opening 26*c* and the recess 26*b* are not in communication with each other, lubricating oil 7 is not supplied to the compression chamber 23.

As described above, according to the third embodiment, lubricating oil 7 lubricates the main ball bearing 42, and the main ball bearing 42 has the shield. Therefore, it is possible to prevent lubricating oil 7 from flowing out toward the motor 5, lubricating oil 7 is supplied from the back pressure chamber oil-supply path 25 to the back pressure chamber 22 through the eccentric ball bearing 43 by the pressure difference, it is possible to increase the amount of oil supplied to the eccentric ball bearing 43 and the main ball bearing 42, and reliabilities of the eccentric ball bearing 43 and the main ball bearing 42 are enhanced.

Since the material of the shield 42*a* of the main ball bearing 42 of this embodiment is the stainless steel plate, strength of the shield 42*a* is enhanced, and the reliability of the main ball bearing 42 is enhanced.

INDUSTRIAL APPLICABILITY of the present invention, it is possible to increase an amount of oil supplied to the eccentric ball bearing and the main ball bearing, and reliabilities of the eccentric ball bearing and the main ball bearing are enhanced. Therefore, it is possible to apply the invention to a use of a scroll fluid machine such as an air scroll compressor, a vacuum pump and a scroll type expansion machine without limiting working fluid to refrigerant.

What is claimed is:

1. A scroll compressor, comprising:

a motor and a compressing mechanism accommodated in a container, and a drive shaft driven by the motor, the compressing mechanism comprising:

an orbiting scroll formed by uprightly standing an orbiting spiral lap on an orbiting panel, a fixed scroll which is combined with the orbiting scroll and which is formed by uprightly standing a fixed spiral lap on a fixed panel, and a main bearing member which has the orbiting scroll disposed between the fixed scroll and the main bearing member and which holds a sealing member, wherein a compression chamber is formed between the orbiting scroll and the fixed scroll, the sealing member is disposed on a back surface of the orbiting scroll, and the sealing member defines an inner side of the sealing member into a high pressure region and defines an outer side of the sealing member into a back pressure chamber, the high pressure region including a drive shaft oil-supply path having an opening located in the vicinity of a main ball bearing, wherein an end of the drive shaft on a side of the orbiting scroll includes an eccentric shaft, a portion of the drive shaft at a boundary between the eccentric shaft and the drive shaft being notched by a flat surface having an angle with respect to the axial direction of the drive shaft, and the opening of the drive shaft oil-supply path being formed in the flat surface, wherein the scroll compressor includes a back pressure chamber oil-supply path through which lubricating oil is supplied from the high pressure region to the back pressure chamber, and a compression chamber oil-supply path through which lubricating oil is supplied from the back pressure chamber to the compression chamber, the compression chamber with which a compression chamber-side opening of the compression chamber oil-supply path is in communication is a compression chamber after working fluid is trapped, and one of openings of the back pressure chamber oil-supply path reciprocates from a location radially inward of the sealing member to a location that is radially outward of the sealing member.

2. The scroll compressor according to claim 1, wherein the compression chamber oil-supply path includes a passage formed in the orbiting scroll, and a recess formed in the panel of the fixed scroll, one of openings of the passage is periodically superposed on the recess in accordance with orbiting motion of the orbiting scroll, thereby intermittently bringing the back pressure chamber and the compression chamber into communication with each other.

3. The scroll compressor according to claim 1, wherein the opening of the drive shaft oil-supply path is located in the vicinity of an eccentric ball bearing.

4. The scroll compressor according to claim 3, wherein the main ball bearing has a shield.

5. The scroll compressor according to claim 1, wherein the drive shaft oil-supply path is inclined with respect to an axial direction of the drive shaft.

6. The scroll compressor according to claim 1, wherein a material of the shield of the main ball bearing is a stainless steel plate.

7. The scroll compressor according to claim 1, wherein the scroll compressor is disposed horizontally by a mounting leg provided on the container.

8. The scroll compressor according to claim 1, further comprising an oil-supply path formed in the drive shaft, and a cylindrical boss portion formed on the back surface of the orbiting scroll, wherein the eccentric shaft is supported by the cylindrical boss portion through an eccentric ball bearing, the drive shaft is supported by the main bearing member through a main ball bearing, the high pressure region includes a first high pressure region surrounded by an inner portion of the cylindrical boss portion and the eccentric ball bearing, and a second high pressure region surrounded by the main bearing member, an outer portion of the cylindrical boss portion, the eccentric ball bearing and the main ball bearing, an outlet of the oil-supply path is in communication with the first high pressure region, an outlet of the back pressure chamber oil-supply path is in communication with the first high pressure region, the outlet of the back pressure chamber oil-supply path is in communication with the second high pressure region when the outlet of the back pressure chamber oil-supply path is at a location inside of the sealing member, and is in communication with the back pressure chamber when the outlet of the back pressure chamber oil-supply path is at a location outside of the sealing member.

9. A scroll compressor, comprising:

a motor and a compressing mechanism accommodated in a container, the compressing mechanism comprising:

an orbiting scroll formed by uprightly standing an orbiting spiral lap on an orbiting panel, a fixed scroll which is combined with the orbiting scroll and which is formed by uprightly standing a fixed spiral lap on a fixed panel, and a main bearing member which has the orbiting scroll disposed between the fixed scroll and the main bearing member and which holds a sealing member, wherein a compression chamber is formed between the orbiting scroll and the fixed scroll, the sealing member is disposed on a back surface of the orbiting scroll, and the sealing member defines an inner side of the sealing member into a high pressure region and defines an outer side of the sealing member into a back pressure chamber, wherein the scroll compressor includes a back pressure chamber oil-supply path through which lubricating oil is supplied from the high pressure region to the back pressure chamber, and a compression chamber oil-supply path through which lubricating oil is supplied from the back pressure chamber to the compression chamber, the compression chamber oil-supply path comprising:

a passage formed in the orbiting scroll, and a recess formed in the panel of the fixed scroll, wherein one of openings of the passage is periodically superposed on the recess in accordance with the orbiting motion of the orbiting scroll, thereby intermittently bringing the back pressure chamber and the compression chamber into communication with each other, the compression chamber with which a compression chamber-side opening of the compression chamber oil-supply path is in communication is a compression chamber after working fluid is trapped, and one of openings of the back pressure chamber oil-supply path reciprocates from a location radially inward of the sealing member to a location that is radially outward of the sealing member, a drive shaft driven by the motor, an oil-supply path formed in the drive shaft for supplying lubricating oil to the drive shaft oil-supply path, an eccentric shaft formed on one end of the drive shaft, and a cylindrical boss portion formed on the back surface of the orbiting scroll, wherein the eccentric shaft is supported by the cylindrical boss portion through an eccentric ball bearing, the drive shaft is supported by the main bearing member through a main ball bearing, the high pressure region includes a first high pressure region surrounded by an inner portion of the cylindrical boss portion and the eccentric ball bearing, and a second high pressure region surrounded by the main bearing member, an outer portion of the cylindrical boss portion, the eccentric ball bearing and the main ball bearing, an opening of the drive shaft oil-supply path is in communication with the second high pressure region, an opening of the back pressure chamber oil-supply path is in communication with the first high pressure region, the opening of the back pressure chamber oil-supply path is in communication with the second high pressure region when the opening of the back pressure chamber oil-supply path is at a location inside of the sealing member, and is in communication with the back pressure chamber when the opening of the back pressure chamber oil-supply path is at a location outside of the sealing member.

* * * * *